United States Patent [19]

Studebaker

[11] 4,070,971

[45] Jan. 31, 1978

[54] ENGINE EFFICIENCY

[76] Inventor: Alden Henry Studebaker, 241 Nenue St., Honolulu, Hawaii 96821

[21] Appl. No.: 476,564

[22] Filed: June 5, 1974

[51] Int. Cl.[2] ..... F02D 13/06

[52] U.S. Cl. ..... 123/198 F; 123/DIG. 1; 123/DIG. 7; 123/192 B

[58] Field of Search ..... 123/198 F, 192 B, 1, 123/DIG. 7, DIG. 1, DIG. 6

[56] References Cited

U.S. PATENT DOCUMENTS

| | | | |
|---|---|---|---|
| 2,284,515 | 5/1942 | Criswell | 123/192 B |
| 2,392,933 | 1/1946 | Mallory | 123/198 F |
| 2,745,391 | 5/1956 | Winkler | 123/198 F X |
| 2,954,022 | 9/1960 | Mick | 123/198 F X |
| 2,955,750 | 10/1960 | Phelps | 123/198 F |
| 3,106,195 | 10/1963 | Hanley | 123/192 B X |
| 3,402,707 | 9/1968 | Heron | 123/192 B |
| 3,520,285 | 7/1970 | Klauder, Jr. | 123/192 B |
| 3,765,394 | 10/1973 | Francis | 123/198 F |
| 3,874,358 | 4/1975 | Crower | 123/198 F |

*Primary Examiner*—Ronald H. Lazarus
*Assistant Examiner*—Ira S. Lazarus
*Attorney, Agent, or Firm*—James C. Wray

[57] ABSTRACT

An 8-cylinder engine is converted to a 4-cylinder engine by disconnecting and removing four alternate firing order pistons and connecting rods, by attaching a counterweight to each crank shaft throw journal from which a connecting rod has been removed, by blocking intake ports with replacement gaskets having obstructions at the ports of the selected cylinders and by adding weights to the flywheel.

11 Claims, 12 Drawing Figures

FIG. 1
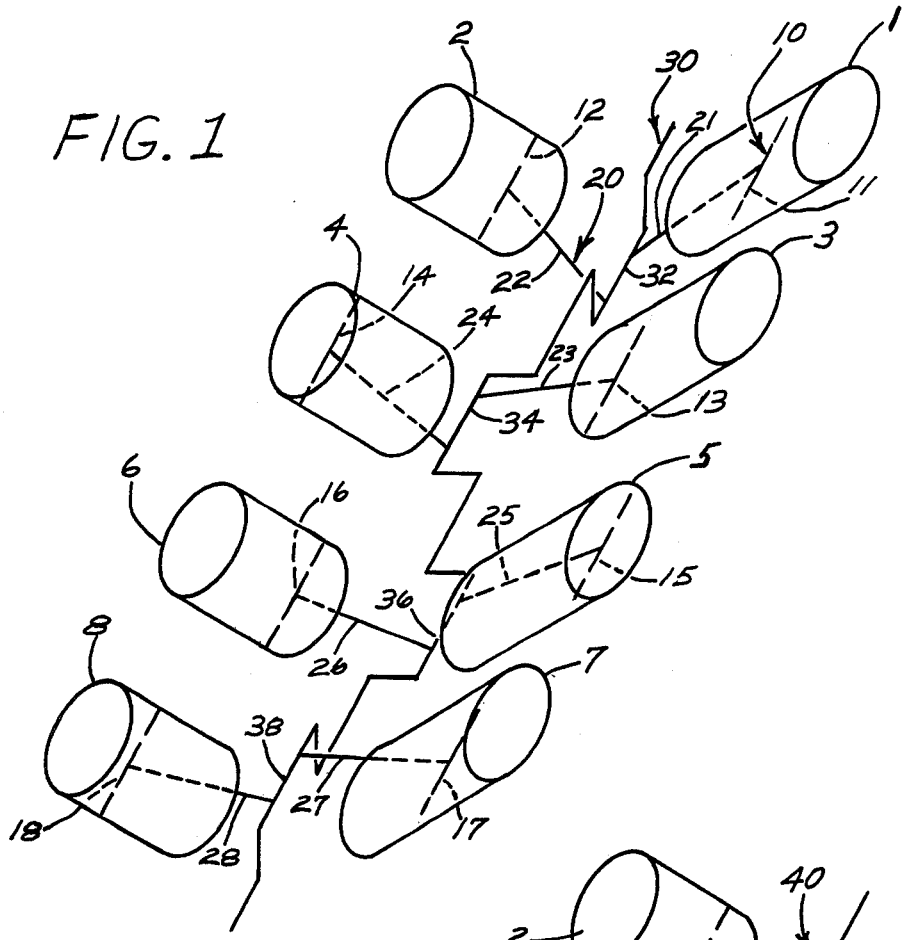
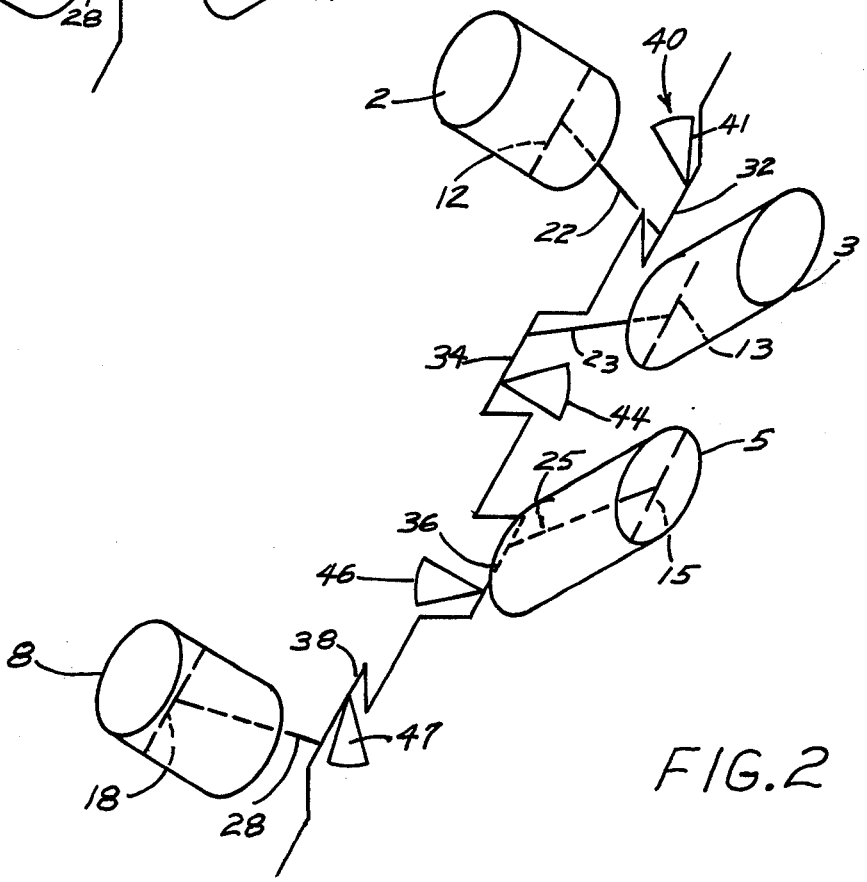
FIG. 2

FIG. 4
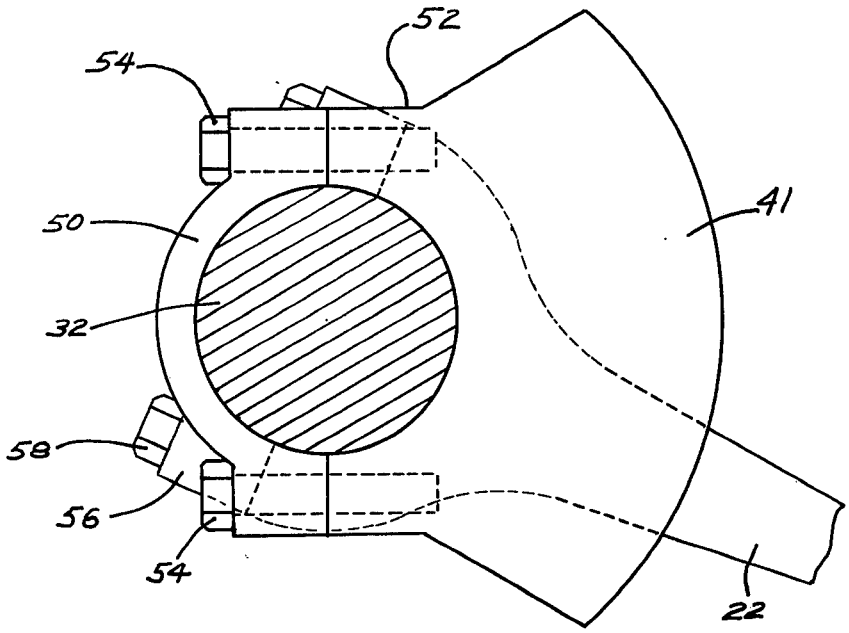
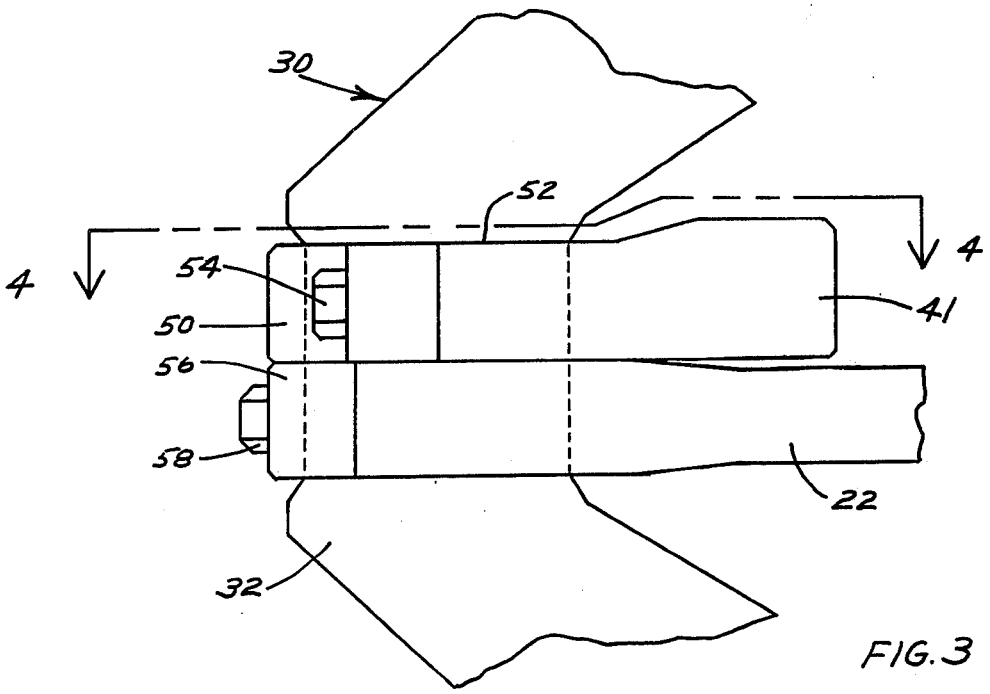
FIG. 3

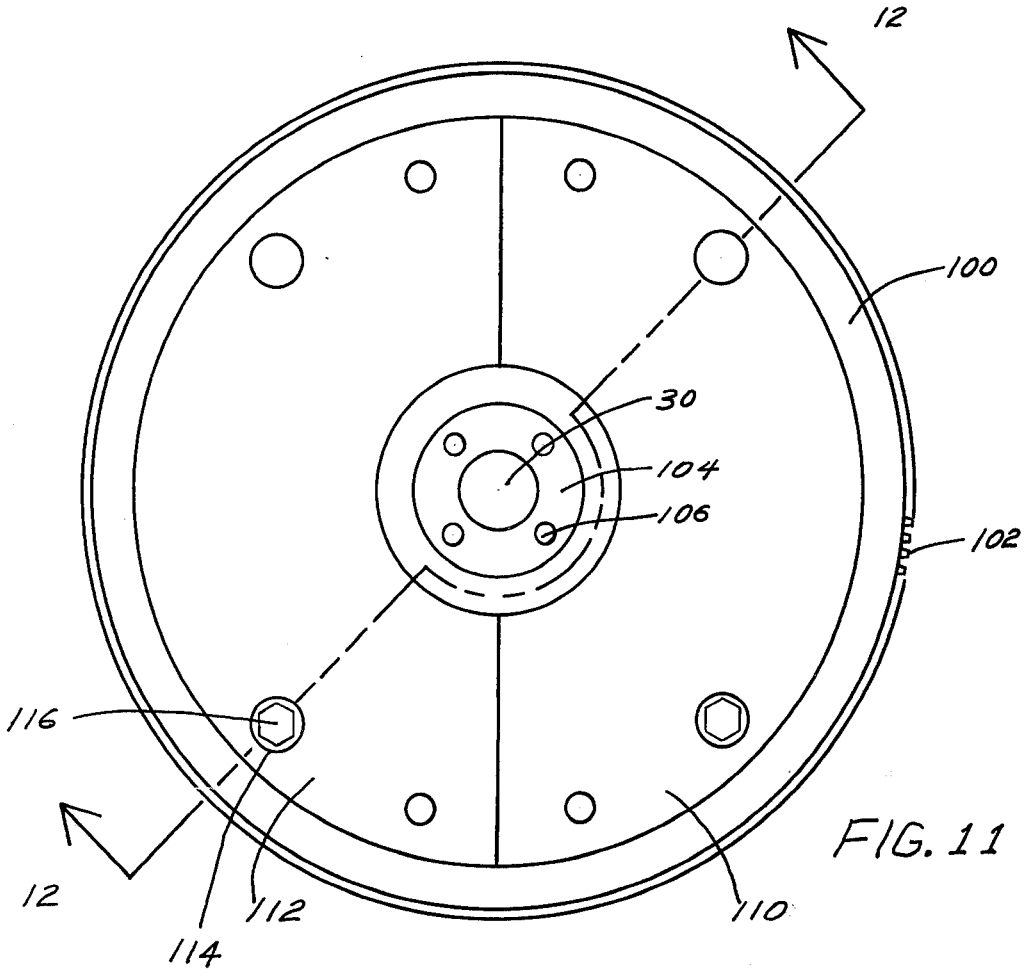
FIG. 11
FIG. 12
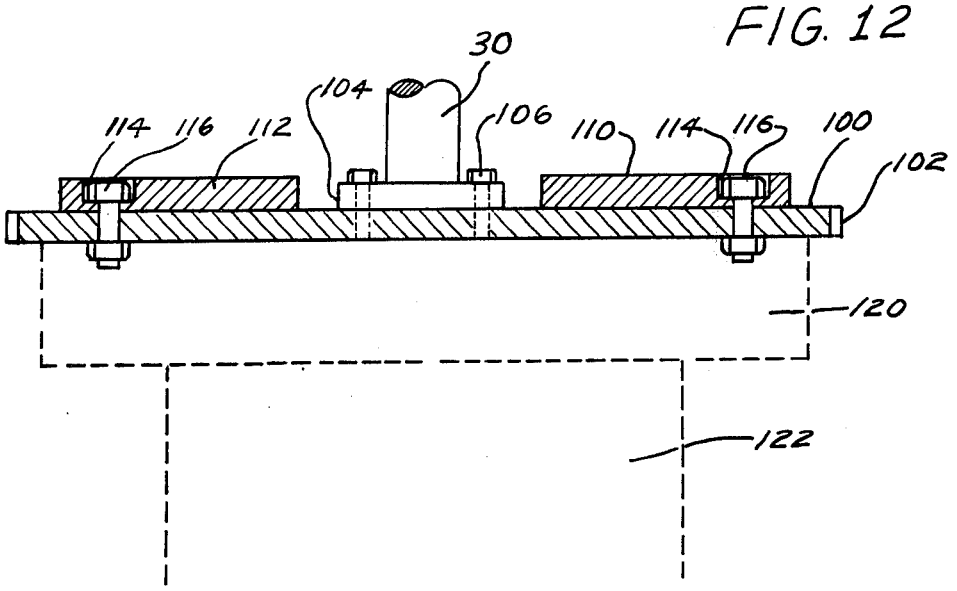

ENGINE EFFICIENCY

BACKGROUND OF THE INVENTION

Many types of engines having rotating shafts are known. Historically, the control of the engines, their power output and their energy consumption have been given great attention.

One of the most important aspects of an engine is providing the correct size engine for the desired use of the engine. Historically, engines have been overdesigned so that they may provide reserve power, which is used, if at all, only during a small percentage of engine operation. The engines, and particularly engines for automobiles, are designed to produce upwards far above their normal usage requirements. The overdesign of engines encourages the driving of automobiles in wasteful and dangerous manners. Overdesigned engines operating in normal power output ranges are inefficient.

A need exists to provide a system for converting engines to maximum efficiency for reducing fuel consumption.

Before preparing an application, the applicant caused a search to be made in the U.S. Patent Office.

The search covered U.S. patents in class 123, subclasses 198, Dig. 7, Dig. 10, and in class 74, subclass 603.

Examples of the most pertinent patents are: U.S. Pat. Nos. 934,675; 1,802,902; 2,218,332; 3,556,063; 842,392; 869,021; 1,201,055; 2,166,968; 2,186,043; 2,250,814; 2,948,274; 3,561,416; 1,350,269 and 491,487.

U.S. Pat. No. 934,675 describes an engine block design adapted to be used with one, two, or three pistons depending on the operating requirements for the engine.

U.S. Pat. No. 3,561,416 shows engine block configurations which can be formed from a combination of 1, 2, or 4 cylinders and pistons.

U.S. Pat. No. 2,250,814 discloses modifications to a V-8 engine whereby 4 cylinders of the engine may be selectively taken out of service. Fuel flow to the unused cylinders is interrupted. Both intake and exhaust valves of the unused cylinders remain closed during operation.

U.S. Pat. No. 2,186,043 describes modifications to multi-cylinder internal combustion engines so that several cylinders can be operated in four-cycle mode, or alternately and the remaining cylinders can be operated in a two-cycle mode.

U.S. Pat. No. 1,350,269 is an example of detachable crank shaft counterbalances found in the prior art.

U.S. Pat. No. 491,487 discloses an adjustable weight crank shaft counterbalance.

The current energy crisis poses a number of challenges to the American public. Currently there is a mad scramble to "economy" cars of both domestic and foreign manufacture. Typically, these "economy" cars utilize small 4 cylinder engines and fuel consumption varies in the range of 18 to 35 MPG.

The market has dropped for the typical gas consuming large cars with 8 cylinder, 8–12 MPG, V-8 engines. Fewer people want them, but a lot of them are around, overall, up to 50 million, with half that many, 25 million, 3 years old or less.

We obviously cannot scrap these cars — so what can be done? A problem remains of what to do with the existing 8 cylinder automobiles.

SUMMARY OF THE INVENTION

One solution is to change engines to half their current 350–450 cubic inch size to 175–225 cubic inches. This would obviously reduce their performance and require a change in driving habits, but the savings in fuel consumption can be significant. This changeover can be easily made by converting the existing V-8 engines to V-4 engines.

A nonpermanent conversion of the typical V-8 engine to a V-4 engine is outlined in the following. V-4 versus V-8 engine economy would result from a number of features.

a. Reduced cubic inches reduces the engine's ability to consume fuel within a given span of time. Heavy footed drivers automatically are throttled.

b. Consumption of fuel at idling, notoriously inefficient, is cut almost in half. Considerable time in city driving is spent with the engine idling.

c. Engines operate in a higher loaded range. With only half as many cylinders, the remaining ones have to work harder. Engines are generally more efficient in their middle to higher load ranges. In most day-to-day driving, big V-8 engines operate under very light load and in less efficient ranges.

d. New electronic ignition systems keep engines tuned better and longer so as to maintain performance and efficiency.

The typical automotive V-8 overhead valve engine of current manufacture is converted to a V-4 engine by the simple process of removing every other cylinder from the firing order. In a typical engine cylinders are numbered from front to rear, the right bank 1 through 4, and the left bank 5 through 8. With a normal firing order of 1-5-4-2 - 6-3 - 7-8, after conversion two possible resulting firing orders exist, i.e., 1-4 - 6-7 or 5-2 - 3-8. Actual selection would depend on what, if any, one gave better overall results.

The pistons and connecting rods of the unused cylinders are removed from the engine. The valves on the unused cylinders are rendered inoperative, remaining in the closed position, by removing lifters and/or push rods.

The ignition and carburation systems will operate as without modification, or with minor modification. However, better performance and efficiency are obtained by used of specially designed solid state ignition systems and improved single barrel carburetor designs. Closures, in the form of simple thin metal blanks over unused intake and exhaust manifold openings are advisable. These easily are incorporated in replacement gasket systems.

Unused crank shaft throws need to be modified. This is accomplished by a simple, specially designed device — a counterweight spacer. It serves three purposes as follows:

1. The removal of four connecting rods and pistons changes the engine balance. Engine balance is restored by specially designed counterweights that clamp on the unused throw journal surfaces in such a manner so as not to damage the surface for reuse as a V-8 crankshaft. Use of a friction material insert would accomplish the latter.

2. The portion of the counterweight adjacent the big end of the remaining connecting rod is designed to act as a spacer so that the remaining connecting rod maintains its normal position on the throw journal and does not move sideways on the journal.

3. The clamp-on attachment of the counterweight spacer automatically closes off the lubricating oil port, thereby preventing a loss of lubricating oil pressure The modified manifold gasket system and the counterweight spacer are new and unique.

Additional improvements in fuel consumption are made by changeover of automatic transmissions to four speed manual shifts. Automobile manufactures have produced such transmissions, therefore designs and production known-how already exist. A changeover of the transmission is a relatively costly one. In some embodiments the magnitude of the imbalance created by the removal of the alternate firing pistons and rods is of such a low level that only spacers without counterweights handle the problem, or at least handle it well enough that an inexpensive conversion is made without counterweights.

A careful evaluation of the trade-offs, i.e., type of conversion, actual fuel savings versus required investment is useful. Such a comparison indicates advisability of changing transmission and changing cylinder numbers as most advantageous. Changing cylinder numbers with a preassembled kit produces a low cost fuel saving conversion.

Briefly, the invention which we considered is a method and apparatus for converting engines from engines with large numbers of cylinders to engines with smaller numbers of cylinders. The conversion has four main aspects:

1. Removing pistons and connecting rods, and rendering valves inoperative by removing lifters and/or push rods.
2. Closing valve openings by inserting metal blanks or preferably by replacing the gasket with a gasket having integrally formed locking devices.
3. Counterbalancing the crank shaft.
4. Adding flywheel counterweights.

One object of the invention is the provision of the method of improving engine efficiency comprising deactivating selected pistons in selected cylinders, interrupting fuel supply to the selected cylinders, and operating the engine with the deactivated piston and interrupted fuel supply.

Another object of the invention is the provision of a method for improving engine efficiency which comprises removing a piston rod from a crank shaft, and removing a piston from a cylinder, and blocking an intake port of a selected cylinder.

The invention has as another object the provision of a method of improving engine efficiency which comprises replacing cylinder head gaskets having exhaust and intake openings adjacent selected cylinders with gaskets having exhaust and intake obstructions adjacent the selected cylinder.

Another object of the invention is the provision of the method of engine conversion comprising attaching a counterweight-spacer to a crank shaft throw journal from which the piston rod has been removed.

A further object of the invention is the provision of a counterweight-spacer for use in an engine comprising a first attachment portion for connection to a crankshaft throw journal, a second counterweight portion extending outward from the first portion in one radial direction from the throw journal.

As a further object the invention provides a counterweight-spacer with an attachment portion having a wide portion axially extending along the crankshaft throw journal, and wherein the wide portion comprises first and second semicylindrical halves having opposite radial extensions for receiving fasteners for joining the sections together, and wherein the weight portion comprises a sectorial outward extension with a segmental outer periphery.

Another object of the invention is the provision of a crankshaft counterweight-spacer with the weight portion extending toward a centerline of the crankshaft.

Another object of the invention is the provision of a manifold gasket for use in an engine conversion kit comprising an elongated, narrow, thin laminated gasket having plural transverse openings at regular intervals and having at least one of the openings blocked by a central laminate which extends across the opening.

Another object of the invention is the method of further adding weight to a flywheel connected to an engine crankshaft, which flywheel weights comprise first and second semicircular plates having relatively large radial dimensions and having relatively small thicknesses and being configured for attaching laterally to a flywheel.

These and other objects and features of the invention are apparent in the disclosure which includes the foregoing and ongoing description and the claims and drawings.

BRIEF DESCRIPTION OF THE DRAWINGS

FIG. 1 is a schematic representation of an 8-cylinder engine.

FIG. 2 is a schematic representation of an engine modified according to the present invention.

FIG. 3 is a detail of a counterweight-spacer on a crankshaft throw journal.

FIG. 4 is a detail taken along line 4—4 of FIG. 3.

FIG. 11 is a side elevation of counterweights added to a crankshaft.

FIG. 12 is a cross-sectional detail taken along line 12—12 of FIG. 11.

DETAILED DESCRIPTION OF THE DRAWINGS

Figure 5:
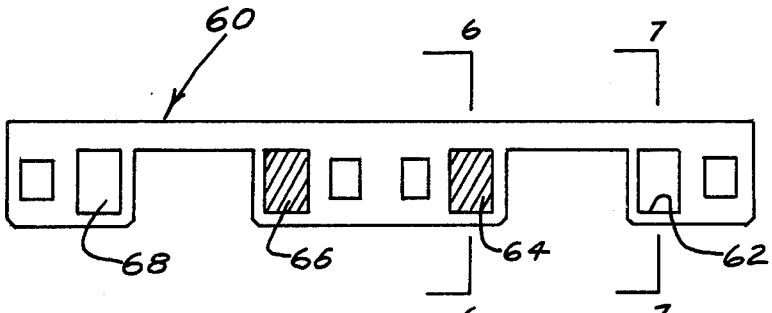
FIG. 5 is a detail in plan view of a replacement gasket according to the present invention.

Referring to FIG. 1, an engine is schematically represented. The V-8 engine has cylinders 1, 3, 5 and 7 on the right bank and 2, 4, 6 and 8 on the left bank. Pistons within the cylinders are generally indicated by the numeral 10. The schematically represented pistons include pistons 11, 13, 15 and 17 in the right bank cylinders and pistons 12, 14, 16 and 18 in the left bank cylinders. Connecting rods or piston rods are generally indicated by the numeral 20. Right-bank cylinders have respectively connecting rods 21, 23, 25 and 27. Connecting rods 22, 24, 26 and 28 are conventionally connected to left-bank cylinders.

A crankshaft is generally indicated by the numeral 30. The crankshaft has several straight sections along a centerline and has throw journal sections 32, 34, 36 and 38 to which are connected large ends of the connecting rods 20. Throw journal 32 holds the crankshaft ends of the connecting rods 21 and 22. Throw journal 34 holds the adjacent rotating large ends of connecting rods 23 and 24. Connectin rods 25 and 26 are connected to throw journal 36, and connecting rods 27 and 28 are connected to throw journal 38.

A conventional firing order in the cylinders shown in FIG. 1 is 1, 2, 7, 3, 4, 5, 6, and 8.

According to the present invention, every other piston and connecting rod in the firing order is removed. As shown in FIG. 2, that leaves the following cylinders in operation: 2, 3, 5 and 8. The firing order in the FIG. 2 representation is according to the following cylinders: 2, 3, 5 and 8.

Counterweights 40 are added to the crankshaft at the throw journals to replace the removed piston rods. As shown in FIG. 2, counterweight 41 is connected to throw journal 32, counterweight 44 is connected to throw journal 34, counterweight 46 is connected to throw journal 36, and counterweight 47 is connected to throw journal 38. The counterweights are numbered according to the piston rods which they replace. As shown in the drawings, the counterweights comprise sectorial elements which extend toward a centerline of the crankshaft.

Referring to FIG. 3, a fragment of crankshaft 30 is shown. The fragment 30 includes the throw portion 32 which contains a finely polished journal surface. An end of connecting rod 22 is mounted on the journal surface for rotation. Counterweight 41 is also mounted on the journal surface. Counterweight 41 has a mounting portion 50 made up of two semicylindrical parts 52 with flanges which extend outward to receive fasteners 54 which are bolts. As is convention in connecting rod practice, the bolts are threaded into internal threads within the larger elements of the paired semicylindrical joint elements. In one embodiment of the invention, bolts 54 tightly draw sections 52 together to fix the counterweight 41 on the journal. In another embodiment of the invention, the counterweight 41 freely rotates about the journal. In another, preferred, embodiment of the invention, the counterweight 41 has a surface next to the surface of connecting rod 22 which holds the counterweight and connecting rod together for like rotation around the journal. As shown in the drawing, the connecting rod is provided with opposed semicylindrical sections 56 which are joined conventionally by bolts 58.

In converting the engine, the intake ports are blocked in cylinders from which pistons and rods have been removed. In a preferred embodiment of the invention, the blocking of the ports is accomplished by removing the associated valves and valve lifter linkages and by removing the head from the cylinders and replacing the conventional gaskets with gaskets which block the intake ports of the selected cylinders.

A left-bank gasket, according to the present invention, is shown in FIG. 5. The gasket 60 has intake port openings 62, 64, 66 and 68 which correspond respectively with cylinders 2, 4, 6 and 8. Since the pistons 14 and 16 have been removed by cylinders 4 and 6, the intake ports 64 and 66 associated with those cylinders are blocked.

Figure 6:
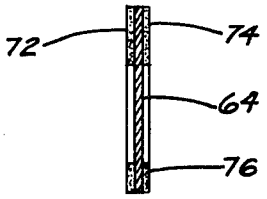
FIG. 6 is a cross-section of the gasket of FIG. 5 taken along line 6—6 in FIG. 5.

As shown in FIG. 6, the gasket comprises three laminates. Outer asbestos or similar material laminates 72 and 74 tightly bind the inner-metallic laminate 76. A portion of the inner laminate 64 extends across the opening normally associated with cylinder 4.

Figure 7:
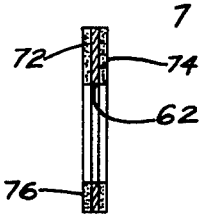
FIG. 7 is a cross-sectional detail taken along line 7—7 in FIG. 5.

As shown in FIG. 7, opening 62 is preserved in the inner laminate 76 of the gasket.

Figure 8:
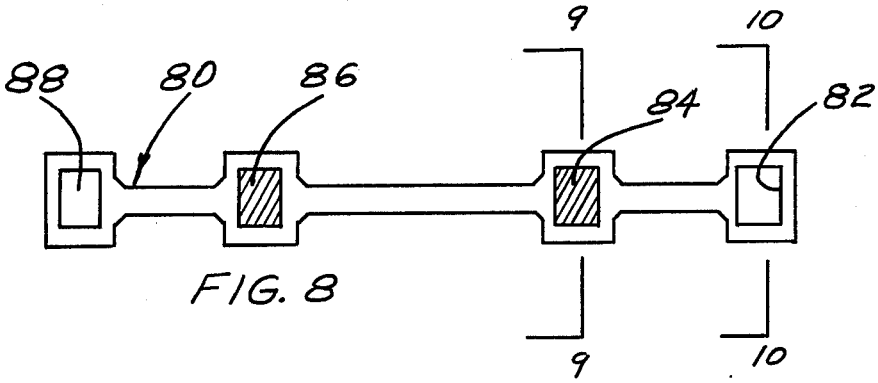
FIG. 8 is an elevation of an alternate replacement gasket for the exhaust system.
Figure 9:
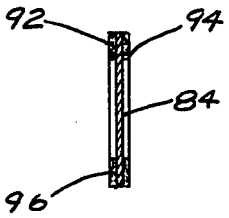
FIG. 9 is a cross-sectional detail taken along line 9—9 of FIG. 8.
Figure 10:
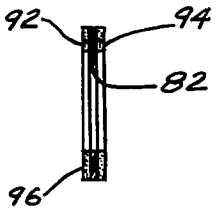
FIG. 10 is a cross-sectional detail taken along line 10—10 of FIG. 8.

An alternate form of gasket is shown in FIG. 8. The gasket 80 is constructed for the left-bank cylinders, 2, 4, 6 and 8. Openings 82, 84, 86 and 88 are provided to correspond with those cylinders. As shown in FIG. 9, the gasket is made of outer laminates 92 and 94 which sandwich inner-metallic laminate 96. In FIG. 9, the opening is closed by a continuation 84 of the gasket material 96. In FIG. 10, the opening 82 is provided in the gasket material 96.

Referring to FIG. 11, weights are added to flywheel 100. Flywheel 100 is provided with peripheral teeth 102 as is convention to engage a starter motor for cranking the engine. Crankshaft 30 has a flange 104 which is bolted to the flywheel with bolts 106. A flywheel weight has two semicircular sections 110 and 112. The sections are generaly flat and have a small internal radius for surrounding the crankshaft flange. A large external radius falls within the maximum radius of the flywheel 100. The semicircular counterweight sections are provided with recesses 114 for receiving fasteners 116 which are normally associated with flywheels for connecting the clutch 120 or fluid drive 120 to the flywheel. Transmission 122 is connected directly to the clutch or fluid drive unit.

Auxiliary holes are provided in the flywheel weights 110 and 112 for additional fasteners, if necessary.

Some engines provide gaskets between cylinder tops and combustion initiation chambers. Those gaskets may be provided with blocking elements to prevent communication between the main cylinder and the combustion initiation chamber of the selected shut-down cylinders.

Some manufacturers of automobiles do not use exhaust manifold gaskets such as shown in FIGS. 8, 9 and 10. Metal-to-metal fits are used instead. In those instances, the gasket material 92 and 94 is omitted and the central metallic core 96 is provided with openings 82 and obstructions 84.

Preferably, the ignition system of the engine is adjusted to skip the firing of the shut-down cylinders. That is not necessary. Preferably, an electronic ignition system is employed.

While the invention has been described with reference to specific examples, it will be obvious to one skilled in the art that modifications and variations of the invention may be constructed and employed without departing from the scope of the invention. The scope of the invention is defined in the following claims.

I claim:

1. The method of improving engine efficiency comprising deactivating selected pistons in selected cylinders by removing the selected pistons, interrupting fuel supply to the selected cylinders, and operating the engine with the deactivated piston and interrupted fuel supply.

2. The method of claim 1 wherein the deactivating step comprises removing a piston rod from a crank shaft, and removing a piston from a cylinder, and wherein the interrupting step comprises blocking and intake port of a selected cylinder.

3. The method of claim 2 wherein the blocking step comprises replacing a cylinder head gasket having an intake opening adjacent a selected cylinder with a gasket having an intake obstruction adjacent a selected cylinder.

4. The method of claim 2 further comprising attaching a counterweight-spacer to a crank shaft throw journal from which the piston rod has been removed.

5. The method of claim 4, the counterweight spacer comprising a first attachment portion for connection to the throw journal, a second counterweight portion extending outward from the first portion in one direction radially from the throw journal.

6. The method of claim 5 wherein the attachment portion comprises an axially-wide portion extending along the journal, and wherein the wide portion comprises first and second semicylindrical halves having opposite radial extensions for receiving fasteners for joining the sections together.

7. The method of claim 5 wherein the weight portion comprises a sectorial outward extension with a segmental outer periphery.

8. The method of claim 5 wherein the weight portion extends toward a centerline of the crank shaft.

9. The method of claim 4, the manifold gasket comprising an elongated, narrow, thin laminated gasket having plural transverse openings at regular intervals and having at least one of the openings blocked by a central laminate which extends across the opening.

10. The method of claim 1 further comprising the step of adding weight of a flywheel connected to an engine crank shaft.

11. The method of claim 10, the weight comprising the first and second semicircular plates having relatively large radial dimensions and having relatively small thicknesses and being configured for attaching laterally to a flywheel and together forming a circular weight having a circular central opening.

* * * * *